US005392495A

United States Patent [19]

Horn

[11] Patent Number: 5,392,495

[45] Date of Patent: Feb. 28, 1995

[54] AIRLINE SEED COTTON CLEANER

[76] Inventor: James L. Horn, P.O. Box 53785, Lubbock, Tex. 79453

[21] Appl. No.: 110,052

[22] Filed: Aug. 20, 1993

[51] Int. Cl.[6] ..... D01B 1/04

[52] U.S. Cl. ..... 19/55 R; 19/48 R; 19/64.5

[58] Field of Search ..... 19/39, 40, 41, 42, 48 R, 19/55 R, 57, 58, 62 R, 63, 64.5, 200, 202

[56] References Cited

U.S. PATENT DOCUMENTS

| | | | |
|---|---|---|---|
| Re. 25,780 | 5/1965 | Brooks . | |
| 616,466 | 12/1898 | Hutchinson . | |
| T971,001 | 6/1978 | Mangialardi, Jr. . | |
| 1,445,379 | 2/1923 | Woodford . | |
| 1,751,306 | 3/1930 | Cumpston . | |
| 2,096,208 | 10/1937 | Streun . | |
| 2,739,353 | 3/1956 | Mitchell et al. | 19/57 |
| 2,744,293 | 5/1956 | Johnson . | |
| 3,027,604 | 4/1962 | Shelburne . | |
| 3,136,003 | 6/1964 | Jennings . | |
| 3,370,327 | 2/1968 | Van Doorn . | |
| 3,512,237 | 5/1970 | Elder et al. . | |
| 3,988,806 | 11/1976 | Bledsoe . | |
| 4,223,423 | 9/1980 | Foerster . | |
| 4,399,591 | 8/1983 | Schwartz et al. | 19/202 |
| 4,637,096 | 1/1987 | Wise et al. . | |
| 4,856,148 | 8/1989 | Columbus . | |
| 5,173,994 | 12/1992 | Gillum et al. . | |

*Primary Examiner*—Clifford D. Crowder
*Assistant Examiner*—Michael A. Neas
*Attorney, Agent, or Firm*—Wendell Coffee

[57] ABSTRACT

Seed cotton is cleaned in a cotton gin by wiping it over grid bars having a large gap between them. In this manner more cotton per hour may be cleaned. Excessive seed cotton falling through the grid bars with the trash is reclaimed by saw cylinder reclaimers. The cotton with the least amount of trash has the trash from a preliminary reclaimer going to the saw cylinder receiving cotton with more trash. The seed cotton which has been reclaimed may be further cleaned by wiping it across a grid bar and thereafter reclaiming any cotton which might go through the grid bars of the reclamation wiper cleaner. By-passes are provided to by-pass the cleaner cotton that passes through grid bars into the main stream of cleaned cotton. Also, the cotton which is first reclaimed can be passed into the stream of clean cotton without further cleaning. Trash which settles from air after passing a separation screen is collected on trap doors and dumped into the cleaner to be cleaned by the wiper-type cleaners and disposed of with the trash from the wiper-type cleaners.

11 Claims, 4 Drawing Sheets

AIRLINE SEED COTTON CLEANER

CROSS REFERENCE TO RELATED APPLICATION

None, however, applicant filed Disclosure Document Ser. No. 325,410 on Feb. 22, 1993, which document concerns this application; therefore, by separate paper it is respectfully requested that the document be retained and acknowledgment thereof made by the Examiner. (MoPEP 1706)

BACKGROUND OF THE INVENTION (1) Field of the Invention

This invention relates to cotton gins, and more particularly to cleaning seed cotton before the seeds are separated from the lint of the seed cotton. A cotton ginner has ordinary skill in this art.

(2) Description of the Related Art

When cotton is harvested by a stripper-type cotton harvester the seed cotton will contain a large amount of burrs, sticks, stems, trash, dirt, etc. About forty percent of the total weight of stripped seed cotton brought to the cotton gin will be this type of trash, and only sixty percent or less, of the material will be clean seed cotton consisting of lint and cotton seed.

In ginning cotton the preparation of seed cotton to be fed to the gin stands is well known.

Basically there are two principal types of preparation, one of which is the wiping the cotton across a screen or grid. Normally in the practice of this, the cotton is wiped across a screen or grid by spiked rollers. Examples of such a system is shown in STREUN U.S. Pat. No. 2,096,208.

The other type of preparation is where the locks of seed cotton are snagged upon saw teeth and then the trash, sticks, burrs, etc., are knocked off by bars adjacent the saw teeth.

ELDER U.S. Pat. No. 3,512,273, shows such a system where the cleaner is mounted upon a cotton stripper, which is to say that this initial step occurs before the harvested seed cotton is taken to the cotton gin. BLEDSOE U.S. Pat. No. 3,988,806 also shows such a system where the process takes place in the cotton gin.

It is noted that ELDER '273 uses two saw cylinders, with the trash from one of the saw cylinders falling upon the other saw cylinder along with some seed cotton. Also, by use of valves, the entire cleaning process can be by-passed and the harvested seed cotton fed directly to the basket as cleaned cotton.

Cleaners having saws are also common in use for cleaning the lint cotton, which is the cotton after having the seed removed. Examples of such cleaners include FOERSTER U.S. Pat. No. 4.223,423. GILLUM U.S. Pat. No. 5,173,994 shows such a system wherein the cotton is twice cleaned. I.e., after the lint is doffed from the first saw cylinder it is caught on the teeth of the second saw cylinder to again be cleaned. SHELBURNE U.S. Pat. No. 3,027,604 shows lint cleaners with various by-passes. BROOKS U.S. Re. No. 25,780 also shows a lint cleaner with by-passes.

MANGIALARDI, Jr. in published application T971,001 discloses reclaiming the lint from the trash of the lint cleaners and thereafter recycling the reclaimed lint for further processing.

In standard wiper-type cleaners it is generally accepted that each foot of width of the cleaner will handle one and one-half or two bales per hour. I.e., a cleaner with an eight foot width, which is to say that the spiked cylinders would be eight feet in length, would have a capacity of about 12 bales per hour for stripped cotton containing considerable burrs and sticks; or about 16 bales per hour when handling picked cotton which had far less burrs, sticks, and trash therein.

SUMMARY OF THE INVENTION (1) Progressive Contribution to the Art

The cleaner system as disclosed in this application is basically an air-line cleaner, which is to say the cotton is wiped across a series of bars to clean the burrs, sticks, trash, etc., from the seed cotton. However, by the practice of the system as described in this application, the capacity of the system can be at least doubled, if not more. I.e., instead of the customary one and one-half bales per hour per foot length of the spiked cylinders, that the capacity can be increased to three bales or more of cotton per foot length per hour of seed cotton.

This increased capacity is accomplished by increasing the spacing between the cleaner bars that the cotton is wiped across by the spiked cylinders. When this width is increased, more seed cotton will fall through the cleaner bars with the trash. This invention discloses a reclamation of the seed cotton which falls between the bars by the use of saw cylinders, wherein the cotton is snagged upon the saw teeth and then separated from the burrs, sticks, trash, etc., by beating the snagged cotton across knocker bars to knock loose the additional trash.

Because much of the cotton will never fall through the cleaner bars, the cotton passing onto the saw cylinders will be greatly reduced in comparison to a system where all of the cotton is cleaned by snagging the cotton on the saw cylinders. Also, to prevent loss, the trash from one of the saw cylinders can be reclaimed by another reclamation saw.

Further it is disclosed herein that the cotton which is reclaimed may have an additional cleaning step, inasmuch as this reclaimed cotton will ordinarily have more trash than even the harvested seed cotton.

There has also been a problem with the seed cotton cleaners because normally the seed cotton is conveyed into the cotton gin by a suction. Therefore when the seed cotton is separated from the air the air itself will contain a great deal of the fine dirt, leaf trash, and other trash. Often the separation of air from seed cotton will be by blowing the trash through a stationary screen. After the trash is blown through the stationary screen, a certain amount of the trash will fall out from the air at that point and result in a problem of its removal from the air screen. This problem has been solved by providing trap doors where this trash normally collects, which can be opened to allow the trash to fall into the seed cotton cleaner so that it will be disposed of with the remainder of the trash. It will be understood that normally, the air resulting from the suction of the cotton must be cleaned before it is released to the atmosphere to prevent dust and leaf trash pollution of the atmosphere. Therefore it is advantageous if the trash can be disposed of without having to separate the trash from the air as an additional step.

(2) Objects of this Invention

An object of this invention is to clean trash from seed cotton.

Another object of this invention is to clean as much trash as possible from the seed cotton without a loss of seed cotton mixed with the trash.

A further object of this invention is to have a seed cotton cleaner having a large capacity for a cleaner of as small a width (cylinder length) as possible.

Further objects are to achieve the above with devices that are sturdy, compact, durable, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

As an aid to correlating the terms of the claims to the exemplary drawing(s), the following catalog of elements and steps is provided:

| | |
|---|---|
| 10 | building |
| 12 | raw seed cotton |
| 13 | fan |
| 14 | seed cotton cleaner |
| 15 | conveyor |
| 16 | gin stands |
| 18 | duct |
| 20 | screen |
| 22 | condenser |
| 23 | saw lint cleaner |
| 24 | plenum |
| 25 | baler |
| 26 | top of cleaner |
| 28 | wipers |
| 30 | shaft |
| 32 | trap door |
| 34 | rod |
| 36 | wall |
| 37 | spring |
| 38 | handle |
| 40 | spiked drums |
| 41 | rotation means |
| 42 | concaves |
| 44 | wiper bars |
| 46 | shaft |
| 48 | inlet |
| 49 | inlet end |
| 50 | scrolls |
| 51 | outlet end |
| 52 | chute |
| 54 | cotton drop box |
| 56 | reclaimer unit |
| 58 | funnel |
| 60 | main saw cylinder |
| 62 | brush |
| 64 | knocker bars |
| 66 | main doffer cylinder |

-continued

| | |
|---|---|
| 68 | skimmer valve |
| 69 | skimmer rod |
| 70 | funnel |
| 72 | kicker |
| 74 | preliminary saw cylinder |
| 76 | brush |
| 78 | knocker bars |
| 80 | housing |
| 82 | chute |
| 84 | kicker |
| 86 | grid bars |
| 88 | final reclamation saw cylinder |
| 90 | brush |
| 92 | knocker bars |
| 93 | doffer |
| 94 | trash drop box |
| 95 | trash conveyor |
| 96 | by-pass valve |
| 98 | rod by-pass |

DESCRIPTION OF THE PREFERRED EMBODIMENTS

Figure 1:
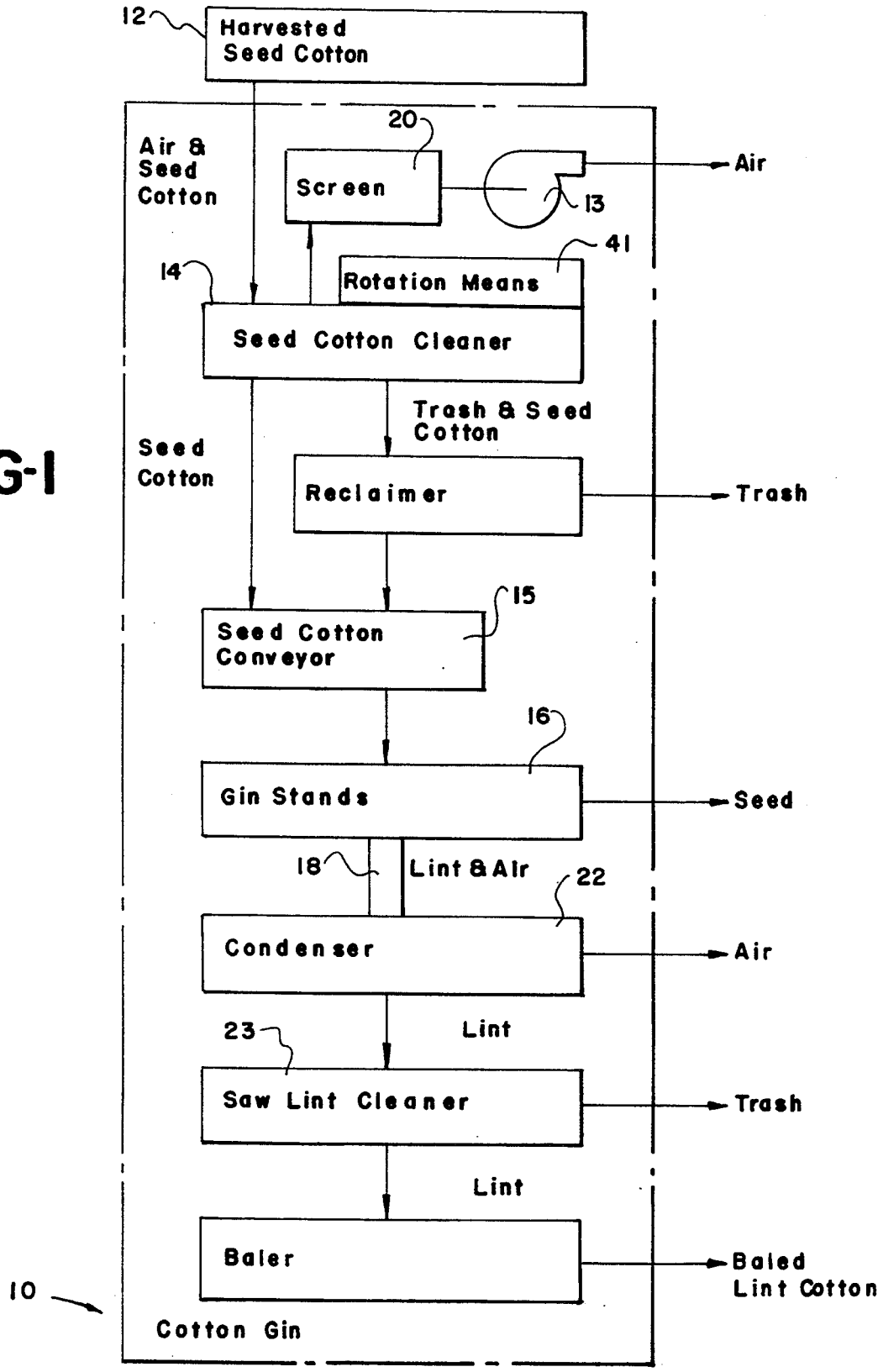
FIG. 1 is a flow diagram showing the flow of cotton through a cotton gin.

Referring to the drawings, and particularly to FIG. 1 there may be seen schematically represented a cotton gin. The cotton gin is represented as being housed within building or structure 10. Harvested seed cotton 12 is brought to the gin building by trailers, modules, or the like, and is conveyed into the building therefrom. Normally the seed cotton is conveyed by a suction produced by fan 13. While it is entrained in the air, the cotton will receive its first cleaning in seed cotton cleaner 14.

The clean seed cotton from the seed cotton cleaner 14 will pass through a drop box (not shown on FIG. 1,) into conveyor 15 where it is conveyed into gin stands 16. The gin stand is that particular piece of cotton gin machinery where the cotton seed is separated from the lint. The lint is normally doffed from saws in the gin stand and is conveyed by the air produced by the doffing through duct 18 to condenser 22. The condenser separates the air from the lint and the lint is cleaned by saw lint cleaners 23. The cleaned lint is conveyed from the saw lint cleaner to press or baler 25 where the cotton is pressed into bales. The baled lint cotton is the principal final product from the cotton gin.

At the seed cotton cleaner 14 the cotton is cleaned by wiping the cotton across a screen as will be described more fully hereafter. The air moves upward through screen 20 to remove lint particles and other particles of material entrained in the air. The air which is directed from the screen through the inlet of fan 13 is cleaner than it would be if not screened.

Those skilled in the cotton ginning art will understand that the description to this point is conventional and known to the art before this invention.

Figure 2:
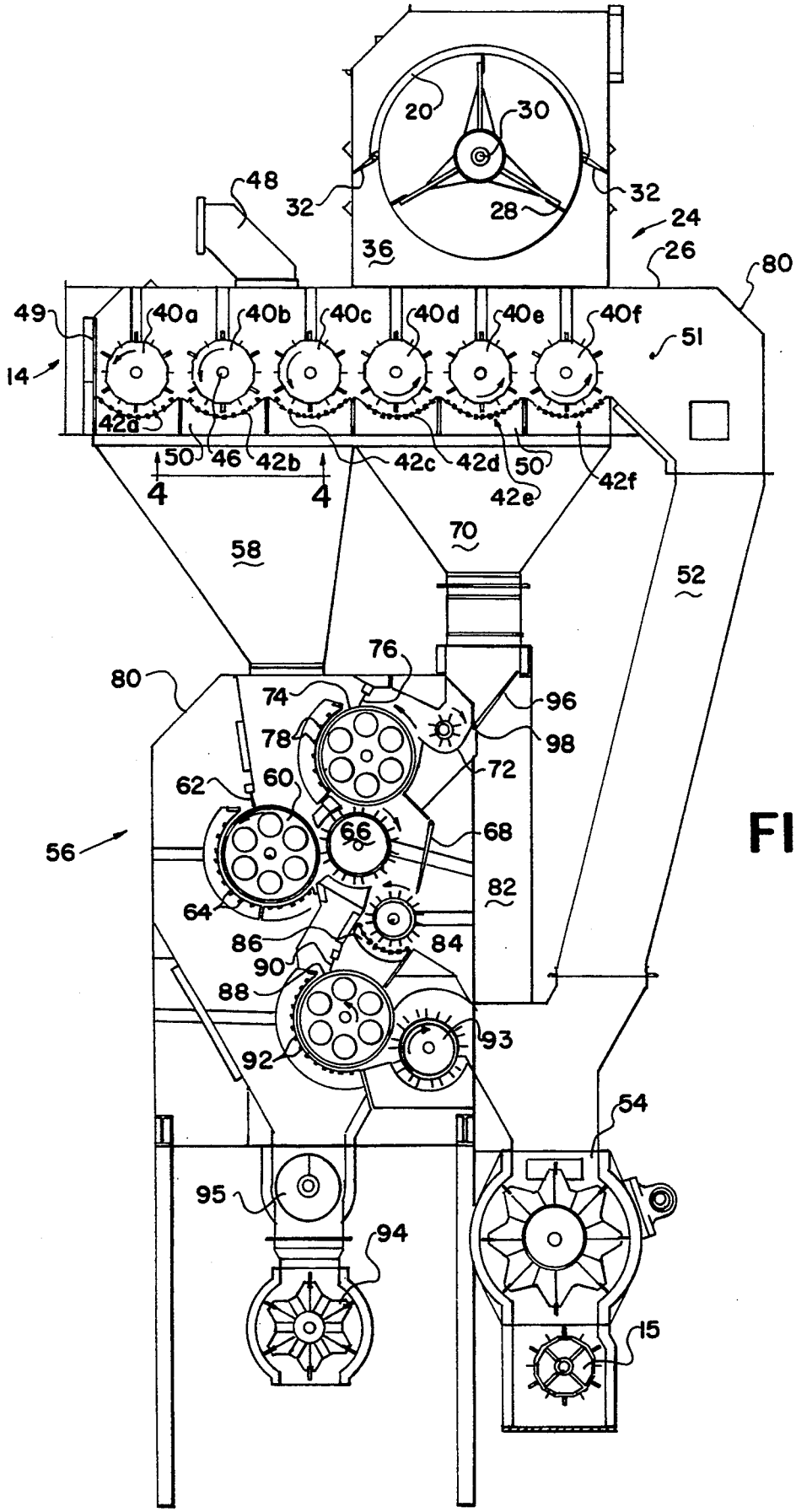
FIG. 2 is a side sectional view of structure of the complete cleaner, air screen, and reclaimer, according to this invention.
Figure 3:
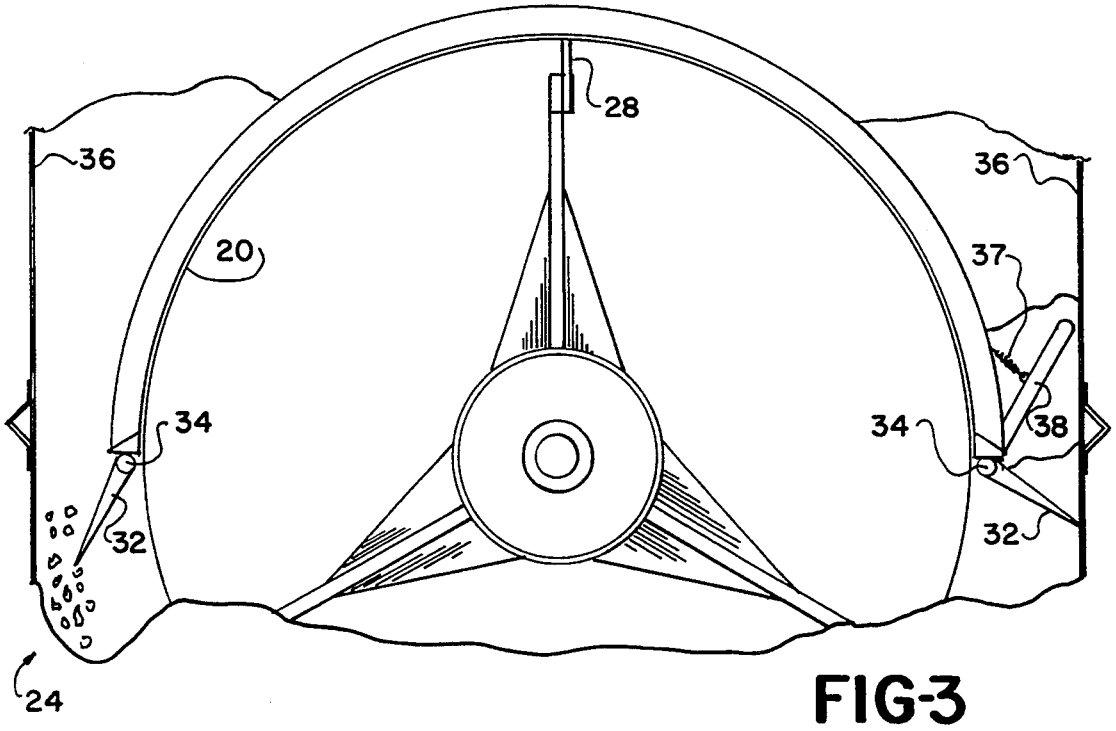
FIG. 3 is a detail of the screen and trap doors with one wall of the plenum partially broken away.
Figure 4:
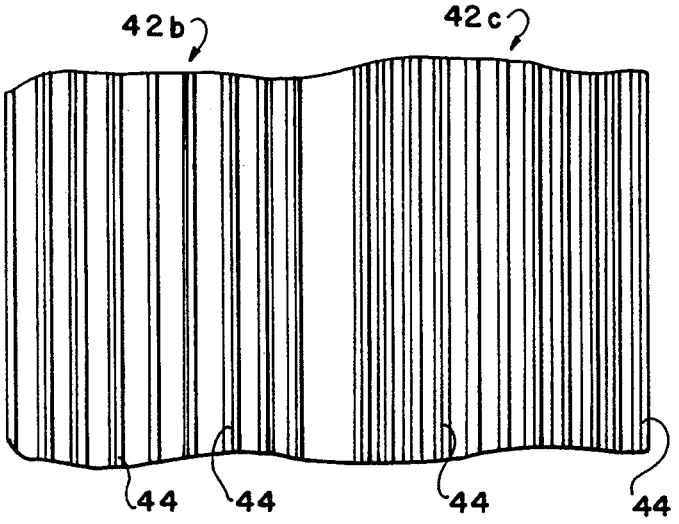
FIG. 4 is a bottom plan view showing the spaced grids of the seed cotton cleaner taken .substantially on line 4—4 of FIG. 2.

Referring to FIGS. 2 and 3 the screen 20 is located within plenum 24 defined by walls 36. The plenum has a rectangular cross section. The plenum between top 26 of the seed cleaner 14 and the fan 13. The screen 20 is hemicylindrical having a horizontal axis. Wipers 28 are mounted upon shaft 30 which is coaxial with the screen. The wipers wipe particles of lint and other, material from the screen so that the air passage through the screen is not impeded.

According to this invention two trap doors, 32 are attached to the plenum 24. One trap door is along one side of the screen 20. The trap door is securely attached to rod 34 which extends along the edge of the screen.

The other edge of the trap door rests against one of the walls 36 of the plenum 24. The rod 34 will be parallel to the shaft 30. The rod is attached to operator or handle 38 located outside of the plenum 24. The handle is a portion of means for opening the trap door so that trash on the top of the trap door falls into the seed cotton cleaner 14 immediately below it. Spring 37 biases the trap door to a normally closed position.

It will be understood that on each side of the screen 20 there will be the rod 34 with the trap door 32 attached to it and a handle 38 upon the end of the rod outside of the plenum 24.

Figure 5:
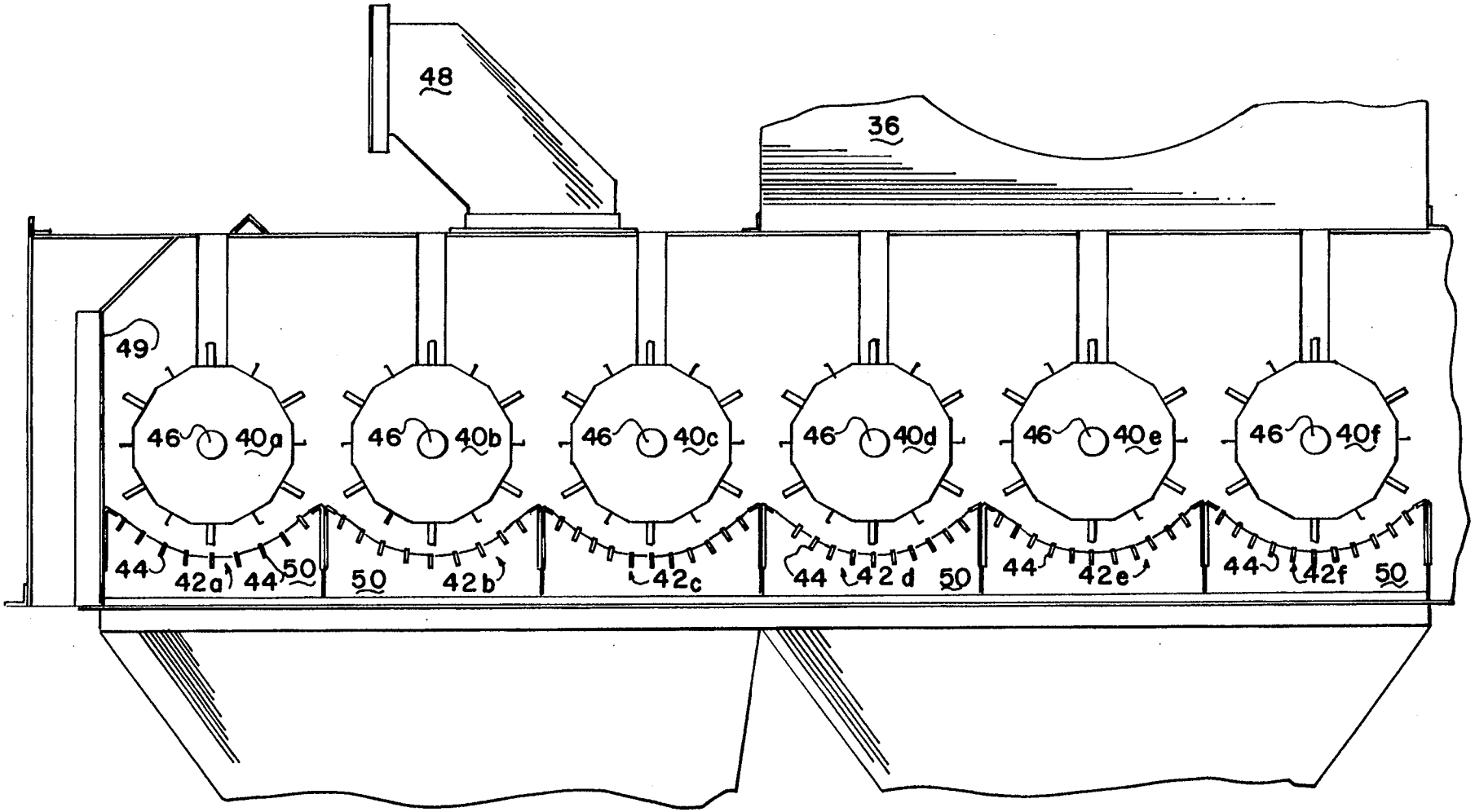
FIG. 5 is a side sectional detail view of the spaced cleaner bars and spiked drums of the seed cotton cleaner.

Referring to FIGS. 2 and 5 there may be seen the 10 seed cotton cleaner 14. As may be seen there are six spiked cylinders or spiked drums 40. The spiked drums are further identified as cylinders or drums 40*a*, 40*b*, 40*c*, 40*d*, 40*e*, and 40*f*. Each drum is over a concave 42 of spaced apart wiper bars or cleaner bars 44. Each of the concaves are identified by their drum, i.e., 42*a*, 42*b*, 42*c*, 42*d*, 42*e*, and 42*f*. Each of the concaves 42 are arcuate and co-axial with shaft 46 upon which its respective spiked drum 40 is mounted for rotation. Rotation means 41 (FIG. 1) rotate drums 40 counter-clockwise as seen in FIGS. 2 and 5 so that cotton which is fed into the cleaner 14 by inlet 48 is wiped across the concaves 42. The spiked drums are spike means for wiping the seed across the cleaner bars 44. By this process trash and some seed cotton falls through the wiper bars.

The cotton inlet is between cylinder 40*b* and 40*c* and the inlet 48 is mounted upon the top 26 of the cleaner 14. The incoming seed cotton will be conveyed along the top of the cylinders 40*b* and 40*a* to the inlet end 49 of the cleaner and wiped across the wiper bars progressively from those under spiked cylinder 40*a* to those under spiked cylinder 40*f*.

The individual wiper bars 44 are made from one-half inch keystock. I.e., they have a square cross section with one half inch on each side. In the concaves 42*a* and 42*b* the wiper bars are mounted in scrolls 50 on inch and three quarters ($1\frac{3}{4}''$) centers. I.e., there will be one and one quarter ($1\frac{1}{4}''$) clearance between adjacent wiper bars. With a clearance of one and one quarter inch, .considerable cotton will fall between the wiper bars. More important, much of the trash will fall between the wiper bars.

The concaves 42*c, d, e,* and *f,* each have the wiper bars mounted on inch and a half centers with a one inch clearance between them.

As described above, this is a wider clearance than normally found in seed cotton cleaners. Therefore more cotton locks of seed cotton will fall between the bars than between the bars of the prior art seed cleaners. However, of course, not as much will fall between the bars as fall between the bars of the concaves 42*a* and 42*b*.

From the final cylinder 40*f* the seed cotton is thrown into chute 52 at the outlet end 51 of the cleaner 14. The seed cotton in chute 52 passes through drop box 54. Drop boxes are well known to the art and are used to permit the solid material, such as locks of cotton, to be dropped but prevent air from leaking in as would otherwise occur because of the fact that the entire seed cleaning apparatus described above is in enclosed housing 80 pneumatically attached to the inlet of fan 13.

As described above, considerable seed cotton will fall between the wiper bars in each of the concaves 42. For this reason reclaimer or reclamation unit 56 is mounted below the seed cotton cleaner 14.

The seed cotton falling through the concaves 42*a*, 42*b*, and 42*c*, are directed by funnel 58 onto main saw cylinder 60. The main saw cylinder has a plurality of saw strips attached to the periphery thereof to snag the locks of seed cotton. The locks of cotton are guided by brush 62 to insure that the locks of cotton are set or well snagged upon the teeth of the saws upon the saw cylinders and then the cotton is carried by a grid of knocker bars 64. The knocker bars 64 are spaced wide apart, for example three inches apart. They are also made of one-half inch key stock. As the locks of cotton are brought by the knocker bars, sticks, burrs and trash will be knocked from the locks of cotton. Then as the saw teeth continue on in their revolution they will be brought to main doffer cylinder 66 and the cotton doffed from the main saw cylinder 60 and thrown in the direction to skimmer valve 68.

The material which drops through the concaves 42*d*, 42*e*, and 42*f*, will be directed by funnel 70 onto kicker 72 which throws the material including locks of cotton upon preliminary saw cylinder 74. The preliminary saw cylinder will also have brush 76 to help set the locks of cotton upon the saw teeth and the cotton snagged upon the saw teeth will be carried by a grid of knocker bars 78 to knock trash from them. The material that passes through knocker bars 78 is then dropped upon the main saw cylinder 60 to reclaim any cotton which may be contained in it. The cotton on the saw cylinders is carried to the main doffer cylinder 66 which also doffs the cotton from the preliminary saw cylinder and with this cotton, as before, throws it toward the skimmer valve 68.

The position of the skimmer valve 68 is adjustable and is mounted upon skimmer rod 69 so it may be adjusted outside of housing 80 of the reclaimer 56. If the handle is moved so that the skimmer valve 68 is rotated counter-clockwise so it is in a horizontal position the doffed cotton will be doffed and thrown into chute 82 where it also will be dropped into the drop box 54.

If the skimmer valve is moved clockwise to a basically vertical position or even past it so that it is at a position of about 6:30 o'clock (referring to a clock face) it may be seen that all of the cotton which is doffed by the main doffer cylinder 66 will be directed to kicker 84. The kicker 84 is also basically a spiked wiper drum that wipes the cotton across the reclamation grid bars 86. Therefore it may be seen that any trash and some locks of cotton would fall through the reclamation grid bars 86. A large portion of the seed cotton is thrown by the kicker 84 under the skimmer valve 68 into the cotton chute 82 where it would go onto the cotton drop box 54. Also it may be seen that any trash and some of the cotton will fall through the grid bars 86. Also cotton will drop through the grid bars 86.

The cotton and trash will fall from the grid bars 86 onto the final reclamation saw cylinder 88. The final reclamation saw cylinder 88 will also have set brush 90, and knocker bars 92. The trash thrown through the knocker bars 92 will also join the trash going through the knocker bars 64 to trash conveyor 95 where the trash will fall through a trash drop box 94 to be conveyed to waste.

Doffer 93 doffs the cotton from the final saw cylinder 88 into the intake of the cotton drop box 54.

Seed cotton dropping through the cotton drop box 54 will drop into the seed cotton conveyor 15 to be conveyed to the gin stand 16 as described above.

Most of the trash will be separated from the seed cotton and fall through the concaves 42*a*, 42*b*, and 42*c*. The material that falls through the concaves 42*d*, 42*e*, and 42*f* will be much cleaner and have very little trash with it. If, in the judgment of the ginner the material falling through the concaves 42*d*, 42*e*, and 42*f*, is sufficiently clean to be fed immediately into the gin stands 16, then the by-pass valve 96 may be opened by rotating its rod 98 in a counter-clockwise position so that the seed cotton drops straight into chute 82 and drop box 54 rather than being reclaimed by the preliminary saw cylinder 74.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. In a cotton gin having a) gin stands for separating seed cotton into lint and cotton seed, b) a seed cotton cleaner for cleaning trash from seed cotton, and c) conveyors for moving the seed cotton from the seed cotton cleaner to the gin stands, d) said seed cotton cleaner having i) spaced apart bars, ii) spike means for wiping the seed cotton across the bars, whereby trash and some seed cotton falls between the bars, e) a fan with its inlet pneumatically connected to the seed cotton cleaner, f) a plenum with walls having a rectangular cross section between a top of the seed cotton cleaner and fan, and g) a hemicylindrical screen having a horizontal axis in the plenum;

wherein the improved structure comprises:

h) two trap doors, one along each side of the screen between the screen and the adjacent wall of the plenum, and j) means for opening the trap doors so that trash on top of the trap doors falls into the seed cotton cleaner.

2. The structure as defined in claim 1 further comprising:

h) a fan with its inlet pneumatically connected to the seed cotton cleaner, j) a plenum with walls having a rectangular cross-section between a top of the seed cleaner and fan, and k) a hemicylindrical screen having a horizontal axis in the plenum.

3. In a cotton gin having a) gin stands for separating seed cotton into lint and cotton seed, b) a seed cotton cleaner for cleaning trash from seed cotton, and c) conveyors for moving the seed cotton from the seed cotton cleaner to the gin stands, d) said seed cotton cleaner having i) spaced apart cleaner bars, ii) spike means for wiping the seed cotton across the cleaner bars, whereby trash and some seed cotton falls between the cleaner bars;

wherein the improved structure of a reclamation unit in combination with the above comprises:

e) at least one saw drum positioned below the spaced apart cleaner bars to snag the seed cotton from the trash, f) grid bars to knock trash from seed cotton snagged on the saw drum, and g) at least one doffing cylinder for doffing the seed cotton from the saw drums, h) said seed cotton cleaner has an inlet end and outlet end, j) said cleaner bars are transverse of a line from the inlet end to the outlet end, and k) said cleaner bars spaced apart a greater distance near the inlet end than the cleaner bars are spaced apart near the outlet end.

4. The structure as defined in claim 3 wherein:

l) said spike means are in the form of a plurality of cylindrical spike drums, m) said spike drums rotatably mounted in the seed cotton cleaner, n) said cleaner bars are mounted in a series of arcuate concaves so that the cleaner bars are below the spikes and near the spike drums, o) means on the seed cotton cleaner for rotating the spike drums so that the spikes adjacent to the cleaner bars move in a direction from the inlet end toward the outlet end.

5. The structure as defined in claim 3 further comprising:

l) said spike means are in the form of six spiked drums, m) said spiked drums rotatably mounted in said seed cotton cleaner, n) said cleaner bars are mounted in a series of arcuate concaves so that the cleaner bars are below the spikes and near the spike drums, o) means on the seed cotton cleaner for rotating the spiked drums so that the spikes adjacent to the cleaner bars move in a direction from the inlet end toward the outlet end, p) said cleaner bars below the first two drums near the inlet are spaced apart a greater distance than the cleaner bars are spaced apart near the remaining four drums near the outlet end, q) there are three of said saw drums positioned below the cleaner bars, designated as a main saw drum, a preliminary saw drum, and a final reclamation saw drum, r) each saw drum having associated knocker bars, s) the main saw drum is positioned below the first three concaves below the first three spiked drums near the inlet end, t) inlet guide means for guiding trash from the first three concaves near the inlet end onto the main saw drum, u) the preliminary saw drum positioned below the three concaves below the three spiked drums near the outlet end, and v) outlet guide means for directing trash from the spaced apart cleaner bars on the concaves near the outlet end onto the preliminary saw drum, w) means for directing trash knocked from the preliminary saw drum onto the main saw drum, x) one of said doffing cylinders designated as a main doffing cylinder for doffing cotton from the main saw drum and the preliminary saw drum, y) means for directing seed cotton doffed by said main doffing cylinder toward a skimmer valve, z) said skimmer valve forming a portion of means for directing seed cotton to one of two directions, aa) said two directions being toward an outlet chute and toward a kicker, bb) said kicker mounted above said final reclamation saw drum, cc) spaced apart reclamation grid bars below said kicker, dd) said final reclamation saw cylinder positioned below said reclamation grid bars to receive cotton and trash that falls between said reclamation grid bars.

6. In a cotton gin having a) gin stands for separating seed cotton into lint and cotton seed, b) a seed cotton cleaner for cleaning trash from seed cotton, and c) conveyors for moving the seed cotton from the seed cotton cleaner to the gin stands, d) said seed cotton cleaner having i) spaced apart cleaner bars, ii) spike means for wiping the seed cotton across the cleaner bars, whereby trash and some seed cotton falls between the cleaner bars;

wherein the improved structure of a reclamation unit in combination with the above comprises:

e) at least one saw drum positioned below the spaced apart cleaner bars to snag the seed cotton from the trash, f) grid bars to knock trash from seed cotton snagged on the saw drum, g) at least one doffing cylinder for doffing the seed cotton from the saw drums, h) there being at least two of said saw drums positioned below the cleaner bars, j) each saw drum having associated knocker bars, and k) means for doffing for each saw drum.

7. The structure as defined in claim 6 wherein:

l) one of said saw drums is positioned below the cleaner bars near the inlet end of the seed cotton cleaner, m) inlet guide means for guiding trash from the spaced apart cleaner bars near the inlet end onto that saw drum, and n) another of said saw drums positioned below the spaced apart cleaner bars near the outlet end, and o) outlet guide means for directing trash from the spaced apart cleaner bars near the outlet end onto that saw drum.

8. The structure as defined in claim 6 further comprising:

l) means for directing trash knocked from one of said saw drums onto another of said saw drums.

9. The structure as defined in claim 6 further comprising:

l) means for directing seed cotton doffed from one of said saw drums is directed to a final of said saw drums.

10. The structure as defined in claim 9 further comprising:

m) a kicker mounted in the reclamation unit between said means for directing the seed cotton doffed from said saw drums and a final saw drum, n) said kicker wiping cotton across a reclamation cleaning grid, o) said final saw drum snagging any cotton passing through said reclamation cleaning grid.

11. The process of operating a cotton gin having a) gin stands for separating seed cotton into lint and cotton seed, b) a seed cotton cleaner for cleaning trash from seed cotton, and c) conveyors for moving the seed cotton from the seed cotton cleaner to the gin stands, d) said seed cotton cleaner having i) spaced apart cleaner bars, ii) spike means for wiping the seed cotton across the cleaner bars, whereby trash and some seed cotton falls between the bars;

e) a fan with its inlet pneumatically connected to the seed cotton cleaner, f) a plenum with walls having a rectangular cross section between the top of the seed cotton cleaner and fan, and g) a hemicylindrical screen having a horizontal axis in the plenum;

wherein the improved method comprises:

h) placing two trap doors, one along each side of the screen, between the screen and the adjacent wall of the plenum, j) opening the trap doors, thereby k) dropping trash on top of the trap doors into the seed cotton cleaner.

* * * * *